United States Patent [19]

Castillo

[11] Patent Number: 4,611,807

[45] Date of Patent: Sep. 16, 1986

[54] EXERCISE APPARATUS HAVING A PAIR OF SPACED APART ROTATING DISCS

[76] Inventor: David D. Castillo, 3808 S. 12th St., Phoenix, Ariz. 85040

[21] Appl. No.: 580,713

[22] Filed: Feb. 16, 1984

[51] Int. Cl.[4] ..... A63B 21/22

[52] U.S. Cl. ..... 272/132; 272/DIG. 4; 272/73

[58] Field of Search ..... 272/131, 132, 134, 136, 272/71, 72, DIG. 4, 23, 143; 128/25 R

[56] References Cited

U.S. PATENT DOCUMENTS

| | | | |
|---|---|---|---|
| 2,777,439 | 1/1957 | Tuttle | 128/25 R |
| 2,783,044 | 2/1957 | Sbarra | 272/132 X |
| 2,921,791 | 1/1960 | Berne | 272/132 |
| 3,301,553 | 1/1967 | Brakeman | 128/25 R |
| 3,309,084 | 3/1967 | Simmons | 272/132 |
| 3,323,366 | 6/1967 | DeLorme et al. | 272/134 X |
| 3,528,653 | 9/1970 | Stuckenschneider et al. | 272/72 |
| 3,721,438 | 3/1973 | Kusmer | 272/132 X |
| 3,744,480 | 7/1973 | Gause et al. | 272/DIG. 6 X |
| 4,060,241 | 11/1977 | Hegel | 272/132 |
| 4,226,415 | 10/1980 | Wright | 272/134 X |
| 4,229,001 | 10/1980 | Roman | 272/DIG. 4 X |
| 4,285,515 | 8/1981 | Gezari | 272/134 X |
| 4,349,191 | 9/1982 | Lambert, Jr. et al. | 272/134 X |
| 4,364,557 | 12/1982 | Serati | 272/132 X |
| 4,436,303 | 3/1984 | McKillip et al. | 272/132 |
| 4,478,213 | 10/1984 | Redding | 128/25 R |
| 4,509,742 | 4/1985 | Cones | 272/73 |

*Primary Examiner*—Richard J. Apley
*Assistant Examiner*—Robert W. Bahr
*Attorney, Agent, or Firm*—H. Gordon Shields

[57] ABSTRACT

Exercise apparatus includes a pair of spaced apart discs journaled for rotation on a frame with adjustable tension elements for varying the force required to rotate the discs. Handles are used to rotate the discs and the handles may be secured to the discs at varying locations to vary the distance between the handles and the axis of rotation of the discs.

14 Claims, 6 Drawing Figures

EXERCISE APPARATUS HAVING A PAIR OF SPACED APART ROTATING DISCS

BACKGROUND OF THE INVENTION

1. Field of the Invention

This invention relates to exercise apparatus and, more particularly, to exercise apparatus including a pair of rotatable discs spaced apart from each other.

2. Description of the Prior Art

U.S. Pat. No. 2,777,439 discloses an exercise apparatus disposed on a frame. The exercise apparatus includes a fixed head movable vertically on the frame, and a rotatable arm secured to the fixed portion. At one end of the arm is a handle. The arm may be adjusted relative to the center of rotation. The torque required to rotate the arm may be varied by adjustment of frictional break elements disposed within the head. A motor may be connected to the head to provide passive type exercise for a patient, or the apparatus may be used in an active mode in which a user rotates the apparatus, with torque required to rotate the apparatus being adjusted as desired.

U.S. Pat. No. 3,721,438 discloses apparatus designed to simulate swimming strokes. The apparatus includes a frame to which are secured a pair of arms rotatable adjacent to a pair of fixed rings, and handles are secured to the arms. The user of the apparatus grasps the handles and rotates the arms. Brake systems are secured between the arms and the fixed rings.

U.S. Pat. No. 4,060,241 discloses another type of exercising device in which a relatively small wheel is journaled for rotation in a frame. Cranks are secured to the wheel and handles extend outwardly from the cranks. A user grasps the handles at the ends of the cranks and rotates the wheel. A frictional engagement is adjustable to vary the force required to turn the crank and thus to provide the exercise by the user. The exercise obtained by a user with the apparatus of the '241 patent is generally of a single type, and is asymmetrical in that the arm muscles are working opposite each other to produce the rotary motion of the cranks and the wheel.

The internal frictional adjustment of the '439 patent is relatively complicated and thus is relatively expensive to make.

In the '241 patent, a direct frictional engagement exists between a rotating wheel and a bar having an arcuate shaped surface which engages the periphery of the wheel. In both the '439 patent and the '241 patent, the frictional engagements illustrated result in wear of the frictionally engaging elements. The apparatus of the present invention includes frictional engagement of rolling members which substantially lessens the wear on the rotating elements. Moreover, the apparatus of the present invention is relatively simple and thus relatively inexpensive.

The apparatus of the present invention is adapted to provide either symmetrical exercise or asymmetrical exercise, as desired by the user.

SUMMARY OF THE INVENTION

The invention described and claimed herein comprises exercise apparatus including a pair of adjustably spaced apart rotatable discs and with adjustable tension being applied to the outer periphery of the rotatable discs to vary the force or torque required to rotate the discs. The discs may be rotated by a user disposed between them either in a parallel relationship, providing symmetrical exercising, or in an alternating relationship, providing asymmetrical exercise.

Among the objects of the present invention are the following:

To provide new and useful exercise apparatus;

To provide new and useful exercise apparatus utilizing a rotating element;

To provide new and useful exercise apparatus including a pair of rotating disc elements;

To provide new and useful exercise apparatus having a rotating disc frictionally engaging a rotatable wheel; and To provide new and useful exercise apparatus having a pair of spaced apart rotatable wheel elements with frictional elements disposed at the periphery of the wheels for varying the force required to rotate the wheels.

DESCRIPTION OF THE PREFERRED EMBODIMENT

Figure 1:
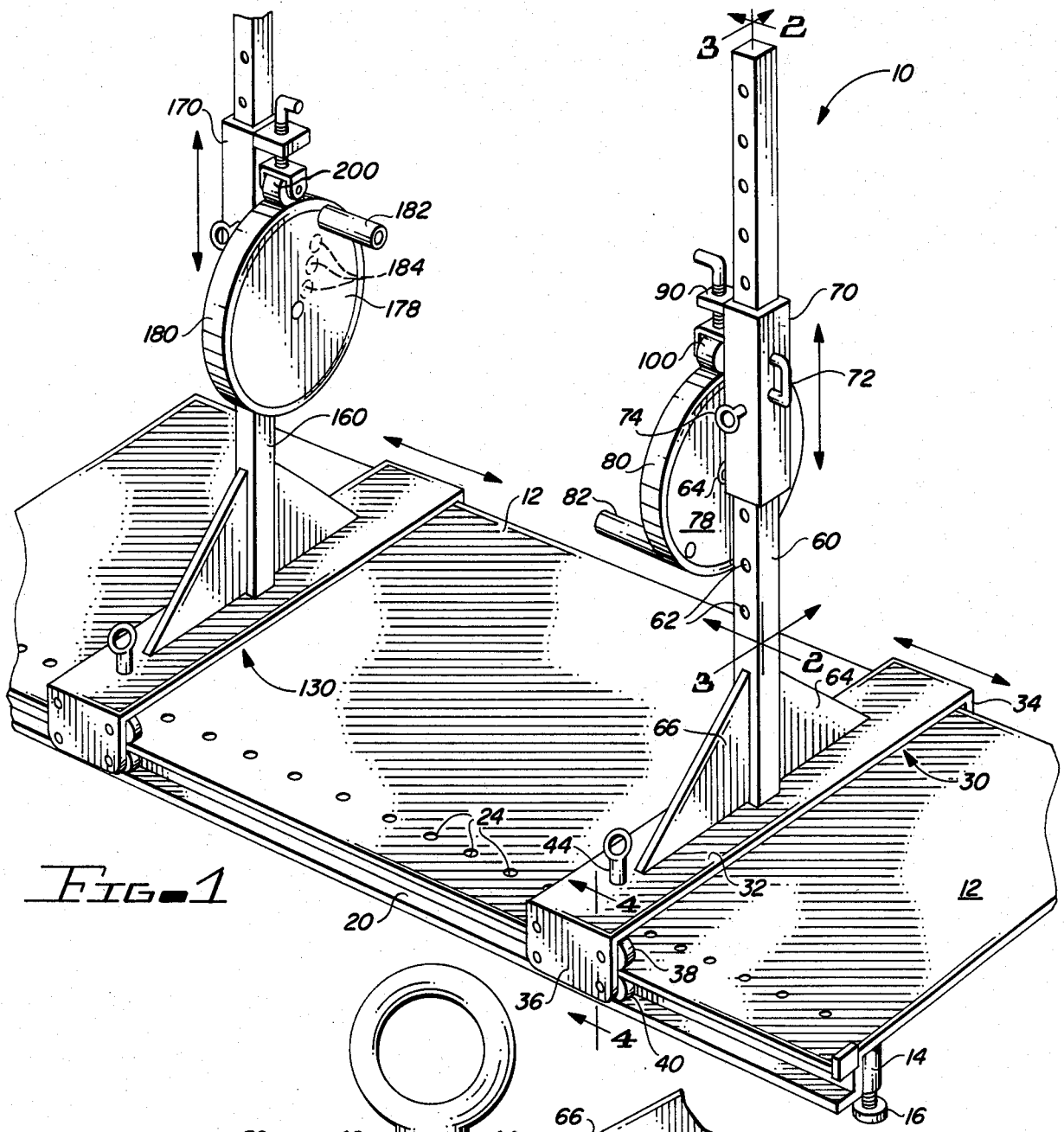
FIG. 1 is a perspective view of the apparatus of the present invention.

FIG. 1 is a perspective view of exercise apparatus 10 embodying the present invention. The exercise apparatus 10 includes a base plate 12 on which are supported a pair of carriages 30 and 130. The carriages 30 and 130 are spaced apart and they are movable on the base plate 12. The carriage 30 includes an exercise wheel or disc 78 and the carriage 130 includes an exercise wheel or disc 178.

Figure 4:
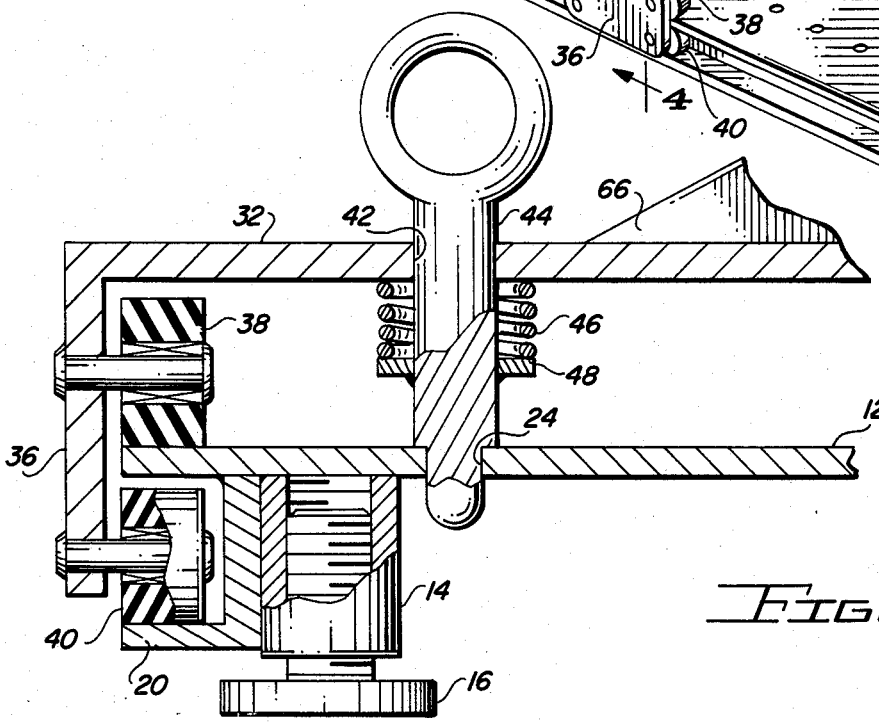
FIG. 4 is an enlarged view in partial section of another portion of the apparatus of the present invention, taken generally along line 4—4 of FIG. 1.

The base plate 12 is supported by a plurality of legs, one of which, a leg 14, is shown in FIG. 1 and in FIG. 4. The leg 14 is appropriately secured to the base plate and is internally threaded to receive an adjustable leveling screw 16. The leveling screw 16 allows the base plate 12 to be leveled when it is placed on an uneven surface, etc.

Figure 2:
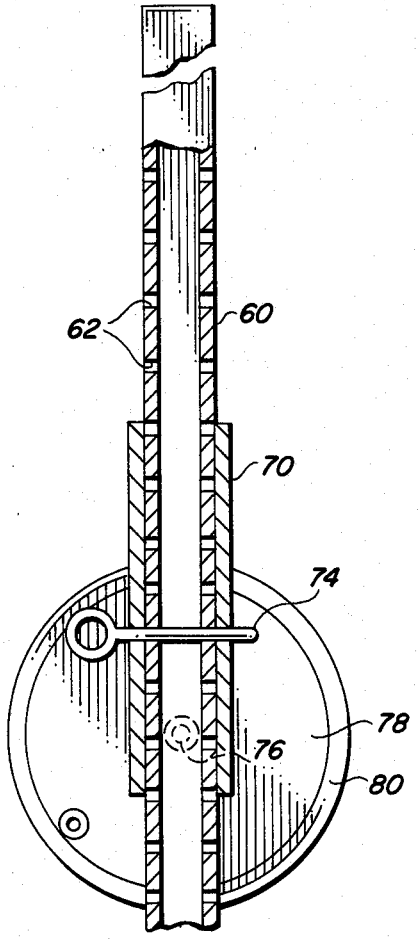
FIG. 2 is a view in partial section of a portion of the apparatus of FIG. 1, taken generally along line 2—2 of FIG. 1.
Figure 3:
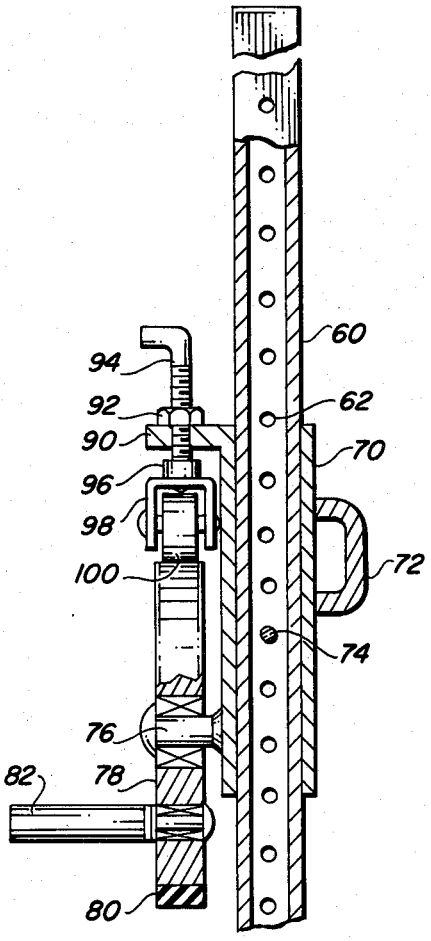
FIG. 3 is a view in partial section of a portion of the apparatus of FIG. 1, taken generally along line 3—3 of FIG. 1.
Figure 5:
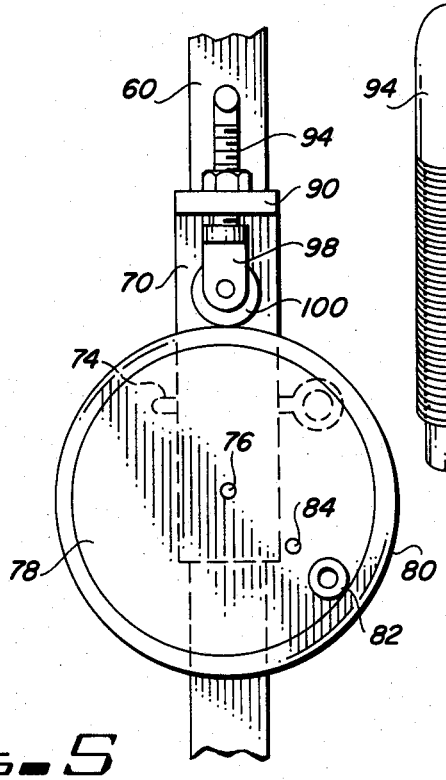
FIG. 5 is an elevational view of a portion of the apparatus of the present invention.
Figure 6:
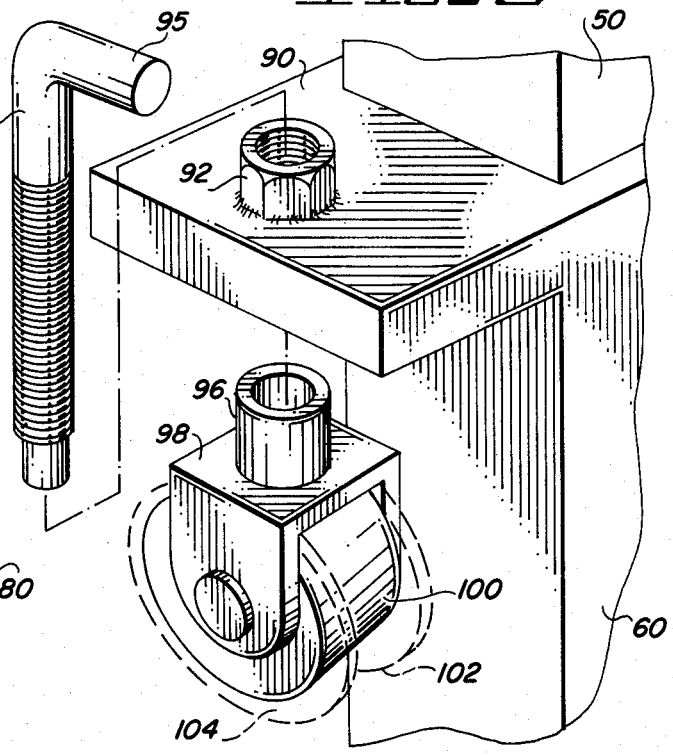
FIG. 6 is an enlarged perspective view, partially exploded, of a portion of the apparatus of the present invention.

FIG. 2 is a view in partial section of a portion of the apparatus of the present invention, taken generally along line 2—2 of FIG. 1. FIG. 3 is a view in partial section of a portion of the apparatus of the present invention, taken generally along line 3—3 of FIG. 1. FIG. 4 is an enlarged view in partial section of a portion of the table 12 and the carriage 30, taken generally along line 4—4 of FIG. 1. FIG. 5 is a front view of a portion of the exercise wheel or disc 78 and its associated structure. FIG. 6 is an enlarged perspective view of a portion of the apparatus of the present invention, with some of the elements exploded to show the details thereof. For the following discussion, reference will be made to FIGS. 1, 2, 3, 4, 5, and 6.

The base plate 12 is preferably a rectangular metal plate supported at its four corners by four legs, each of which is adjustable. One of the legs 14, with its adjustable support element or leveling leg screw 16, is shown in FIG. 1 and is shown in more detail in FIG. 4.

Along the long edges of the rectangular base plate 12 are support elements for wheel assemblies on which the carriages 30 and 130 move. The support elements are preferably angle iron, which include a horizontally extending flange 20. The flange 20 is substantially parallel to the plane of the base plate 12.

A plurality of indexing apertures 24 are disposed along one side of the base plate 12. Their purpose is to enable the carriages 30 and 130 to be locked in place, as desired. Thus, the spacing of the exercise wheels 78 and 178 may be relatively easily established, and as desired, may be moved to other locations to provide other or different spacing. The distance between the apertures 24 may be any convenient distance, as desired. If desired, one carriage may be fixed in place on the base plate.

The carriages 30 and 130 are substantially identical, and accordingly only the carriage 30 will be discussed in detail.

The carriage 30 includes a plate 32 which is generally parallel to the base plate 12, and spaced apart a relatively short distance therefrom. The plate 32 includes a pair of side plates 34 and 36 which extend downwardly from the plate 32, and along the outside edge of the base plate 12. The side plates 34 and 36 support a pair of wheel assemblies. A pair of upper wheels 38 and a pair of lower wheels 40 are shown in FIGS. 1 and 4. The pair of upper wheels 38, of which a single wheel is shown in FIG. 4, is disposed on the top of the base plate 12 and accordingly runs thereon. A pair of lower wheels 40, of which one is shown in FIG. 4, is disposed on the horizontally extending flange 20, and runs thereon. The wheel assemblies 38 and 40 allow the carriage 30 to be easily moved on the base plate 12, and yet prevent the carriage from tipping or from moving in other than a relatively straight or linear manner with respect to the base plate 12.

For locking the carriage 30 to the table 12 there is shown an aperture 42 extending through the plate 32. This is shown in FIG. 4. A lock pin 44 extends through the aperture 42 and into one of the apertures 24 on the base plate 12. The use of the pin 44 effectively locks the carriage and the base plate 12 together.

To provide a positive engagement between the pin 44 and the apertures 24, a compression spring 46 is shown extending between the bottom of the plate 32 and a washer 48 which is appropriately secured to the pin 44. The compression spring 46 provides a bias against the washer 48 and accordingly against the pin 44 to bias the pin 44 downwardly.

The spring 46 need not be very strong, of course. Rather, its purpose is to provide a bias to urge the pin 44 downwardly into an aperture 24 as the carriage 30 is moved on the plate 12. If the pin 44 is moved upwardly against the bias of the spring 46, the carriage 30 may be moved as desired. Once the pin 44 is released, it will automatically move downwardly into the next aperture 24 as the carriage 30 is moved over the base 12. Once the pin 44 extends into a particular aperture 24, the carriage is then locked to the base 12 until the pin 44 is removed by a positive upward movement of the pin 44.

With the locking of the carriage 30 and the base 12, a user of the exercise apparatus 10 need not worry about an inopportune movement of the carriage with respect to the base 12 while the user is exercising with the wheel 78. Since the carriage 130 is substantially identical to the carriage 30, the same is true with respect to the carriage 130 and the wheel 178.

Extending upwardly in the center of the plate 32 of the carriage 30 is a post 60. The post 60 is preferably made of square or rectangular tubing. The post 60 includes a plurality of vertically aligned and spaced apart apertures 62 which extend through opposite sides of the post 60. This is best shown in FIG. 2. The purpose of the apertures 62 is to allow for the vertical placement and securing of a sleeve 70 with respect to the post 60.

For securing the post 60 to the plate 32 of the carriage 30, there are a pair of gussets 64 and 66. The gussets 64 and 66 are appropriately secured, as by welding, to both the post 60 and the plate 32.

The sleeve 70 is also square or rectangular tubing, with its inner dimensions slightly larger than the outer dimensions of the post 60. The sleeve 70 moves on the exterior of the post 60.

For convenience in moving the sleeve 70 relative to the post 60, there is a handle 72 secured to the sleeve. The handle 72 is preferably welded to the sleeve 70. A post type handle may alternatively be used, if desired.

To secure the sleeve 70 in a specific location on the post 60, a pin 74 is used. The sleeve 70 includes aligned apertures extending through opposite walls of the sleeve 70. By raising the sleeve 70, by means of the handle 72, the aligned apertures in the sleeve may be appropriately aligned with any of the aligned apertures 62 of the post 60. At such time as the sleeve 70 is at the desired height, with the respective apertures of both the post and sleeve in alignment, the pin 74 is inserted through the aligned apertures to lock the sleeve 70 to the post 60. This is shown in FIGS. 1, 2, and 3.

An axle or spindle 76 is appropriately secured to the sleeve 70. The axle or spindle 76 receives an exercise wheel or disc 78. The wheel or disc 78 is appropriately journaled for rotation on the axle or spindle 76.

The exercise wheel or disc 78 is preferably made of heavy metal, such as iron or steel, to provide, in and of itself, a substantial amount of weight. On the exterior periphery of the wheel or disc 78 is a rim 80. The rim is preferably rubber or the like.

For rotation or movement of the exercise disc 78, a handle or crank 82 is secured directly to the wheel or disc in any of several locations with respect to the center of the wheel. The handle or crank 82 may be positioned at different locations to provide differing radii from the center of rotation of the wheel 78, depending on the particular needs of the user of the exerciser apparatus 10. One such different location, an aperture 84, is shown in FIG. 5.

For convenience, the handle 82 includes a threaded tip portion which may be screwed directly into a threaded aperture. The handle 82 rotates on its spindle or axle which threads at any of several locations, as desired. The handle 82 preferably extends outwardly from the wheel or disc 78 substantially perpendicularly to the plane of the wheel or disc.

While the exact dimensions of the exercise disc 78, in terms of both weight and diameter, depend on the particular desires of a user, it appears preferable to have the diameter vary between about eighteen and twenty-four inches. Such diameters allow for the placement of the handle 82 at various radii for convenience in rotating the disc for users of various sizes, from youth to mature adults.

To vary the amount of energy required to rotate the exercise wheel or disc 78, a force is applied to the wheel or disc 78 at its rubber rim 80 by means of a wheel 100. The wheel 100 is appropriately secured to a clevice 98, and the wheel is rotatable on its axle or spindle in the clevice 98.

Extending upwardly from the top of the clevice 98 is a socket 96. The socket receives the tip of a threaded shaft 94. The threaded shaft 94 in turn extends through a plate 90. The plate 90 extends outwardly from the upper portion of the sleeve 70. The plate 90 may include a threaded aperture which receives a threaded portion of the shank of the shaft 94. In the alternative, a nut 92 is shown appropriately secured, as by welding, to the plate 90, in alignment with an aperture extending through the plate 90. The internal threads of the nut 92 matingly engage the external threads on the shank of the shaft 94. The shaft 94 in turn is rotated by a handle 95 to force the wheel 100 against the outer periphery of the rim 80, or to withdraw the wheel 100 from the rim 80 of the wheel 78.

By varying the force of the wheel 100 against the rim 80, and thus against the disc 78, a greater or lesser force must be applied through the handle 82 to rotate the wheel or disc 78. The wheel 100 is preferably rubber, or the like, similar to the material out of which the rim 80 is made.

For convenience in maintaining an appropriate, generally parallel, alignment between the wheel 100 and the wheel or disc 78, there is shown in FIG. 6, in dotted line or phantom, a pair of flanges or outwardly extending rims 102 and 104. The flanges or rims 102 and 104 extend outwardly from the outer periphery of the wheel 100, and are thus larger in diameter whan the wheel 100. The rims or flanges 102 and 104 are spaced apart substantially the same, or slightly greater than, the thickness of the disc 78 and its rim 80. The flanges or rims 102 and 104 accordingly extend generally parallel to the disc 78 and thus maintain an appropriate, parallel alignment between the wheel 100 and the disc 78. This prevents the wheel 100 from rotating sideways on the rim 80 as the shaft 94 is turned to apply a greater force on the disc 78.

The shaft 94 includes the handle portion 95. The handle 95 is illustrated as being simply a portion of the shaft 94 extending generally perpendicular to the threaded portion. However, it is obvious that the handle portion 95 may be a circular disc, or any other design preferably inexpensive to manufacture and easy to use.

By rotating the shaft 94 by means of the handle 95, the force required to rotate the wheel or disc 78 may be varied through the wheel 100. The user of the exercise apparatus 10 accordingly can provide a wide range of forces against the wheel 78, and this can vary substantially the amount of effort required by the user to rotate the exercise wheel or disc 78. In addition, by varying the radius through which the user's force is applied on the wheel 78, by varying the location of the handle 82, both the force required and the distance through which the force is exerted may be varied.

While the carriage 30 has been described in substantial detail, the carriage 130 will be described only in terms of its major components. The carriage 130 includes a post 160 extending upwardly from the carriage. An exercise wheel or disc 178 is appropriately journaled for rotation on a sleeve 170. A handle 182 is secured to the disc 178 for rotating the disc. The sleeve 170 is in turn movably secured to the post 160. The post 160, sleeve 170, and exercise wheel or disc 178 are substantially identical to their respective counterparts, namely the post 60, sleeve 70, and disc 78.

Several potential apertures or locations 184 at which the handle 182 may be located are shown in phantom on the face of the exercise disc 178.

A wheel 200, substantially identical to the wheel 100, is appropriately secured to the sleeve 170 and bears against a rim 180 of the disc 178. The wheel 200 and its associated elements are substantially identical to the wheel 100 and its associated elements.

By varying the force of the wheel 200 against the disc 178, the force required to turn the disc 178, through a handle 182, may be varied, all as discussed with respect to the disc 78, its wheel 100, and its handle 82.

By varying the distance between the carriages 30 and 130, the distance between the exercise discs 78 and 178, and their handles 82 and 182, respectively, may be varied. Also, by varying the force of the wheels 100 and 200 against the wheels 78 and 178, the force required to turn the two exercise wheels or discs may be varied. A user accordingly can vary the amount of effort required to rotate the respective exercise wheels or discs.

It will be appreciated that the term "rotate" as used herein may include part revolutions, continuous revolutions, or combinations of either or both, and in either or both directions of rotation. Thus, a user may simulate swimming strokes with the arms in which the wheels 78 and 178 are rotated continuously but with alternate arm movements or with arm movements in unison with each other, as for example freestyle swimming strokes or breast strokes, respectively. In addition, movements simulating curls, reverse curls, and French curls may also be used in which the wheels 78 and 178 are rotated about ninety degrees or more in one direction and then in the opposite direction. Moreover, by lowering the sleeves 70 and 170, and by replacing the handles 82 and 182 with appropriate stirrups or the like, and by employing a bench to sit on, leg exercises may also be accomplished.

It will thus be obvious that virtually any type of weightlifting exercise may be accomplished by the exercise wheels or discs 78 and 178 that are ordinarily accomplished by bars and weights or by other types of exercise machines employing weights, cables, springs, and combinations thereof. However, the exercise apparatus 10 of the present invention is relatively uncomplicated, mechanically, and thus is less expensive to manufacture, use, and maintain, than such prior art exercise apparatus.

It will also be obvious that appropriate gauges may be secured to the apparatus 10 to provide the user with information regarding the force required to move the wheels. Such gauges would be appropriately calibrated in terms of force.

In FIG. 1, and as discussed above, both the carriages 30 and 130 are movable with respect to the base plate 12. It is obvious that, if desired, either the carriage 30 or the carriage 130 may be fixedly secured in place on the base 12, and thus only one of the carriages needs to be movable. For example, the carriage 130 may be fixed in place on the base 12. With the carriage 130 fixed, the carriage 30 may be moved towards or away from the fixed carriage 130 to adjust the spacing between the carriages in accordance with the desires or needs of the user. Moreover, a carriage may be eliminated by securing a post, such as the post 160, directly to the plate 12. Furthermore, even a movable carriage may be obviated by the use of, for example, apertures or receptacles in the base plate 12 to receive a post, such as the post 60. In such case, when the post is to be secured directly to the base, appropriate elements would be provided to prevent both lateral and vertical movement of the post when an exercise wheel or disc is being used. For practical reasons, as may be understood, a movable carriage such as the carriage 30, appears to be preferred.

While the principles of the invention have been made clear in illustrative embodiments, there will be immediately obvious to those skilled in the art many modifications of structure, arrangements, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Exercise apparatus, comprising, in combination:
base means;
post means secured to the base means;
disc means, including a first exercise disc and a second exercise disc, rotatably secured to the post means for providing exercise to a user while rotating the disc means;
handle means, including a first handle secured directly to and rotatable with the first exercise disc and a second handle secured directly to and rotatable with the second exercise disc for rotating the first and second exercise discs; and
wheel means adjustable disposed against the disc means to vary the force required to rotate the disc means.

2. The apparatus of claim 1 in which
the post means includes
a first post, and
a second post spaced apart from the first post;
the disc means includes
the first exercise disc rotatably secured to the first post, and
the second exercise disc rotatably secured to the second post; and
the wheel means includes
a first force wheel adjustably disposed against the first exercise wheel to vary the force required to rotate the first exercise wheel, and
a second force wheel adjustably disposed against the second exercise wheel to vary the force required to rotate the second exercise wheel.

3. The apparatus of claim 2 in which the post means further includes a first carriage adjustably disposed on the base means, and the first post is disposed on the first carriage to vary the spacing between the first exercise disc and the second exercise disc.

4. The apparatus of claim 1 in which the post means further includes a post and a sleeve adjustably secured to the post, and the disc means is rotatably secured to the sleeve.

5. The apparatus of claim 4 in which the wheel means is secured to the sleeve adjacent to the disc means.

6. The apparatus of claim 1 in which the base means includes a base plate.

7. The apparatus of claim 6 in which the base means further includes means for leveling the base plate.

8. The apparatus of claim 6 in which the post means includes
a first post secured to the base plate,
a first sleeve movable upwardly and downwardly on the first post,
a second post spaced apart from the first post and secured to the base plate,
a second sleeve movable upwardly and downwardly on the second post, and
the first exercise disc is rotatably secured to the first sleeve, and the second exercise disc is rotatably secured to the second sleeve.

9. The apparatus of claim 8 in which the wheel means includes a first force wheel secured to the first sleeve and a second force wheel secured to the second sleeve.

10. The apparatus of claim 9 in which the post means further includes a first carriage movably secured to the base plate, and the first post is secured to the first carriage to vary the spacing between the first post and the first exercise disc and the second post and the second exercise disc.

11. The apparatus of claim 10 in which the post means further includes a second carriage movably secured to the base plate, and the second post is secured to the second carriage.

12. The apparatus of claim 1 in which the disc means further includes rim means, and the wheel means is adjustably disposed against the rim means.

13. The apparatus of claim 12 in which the disc means further includes a first disc and a second disc; and the rim means includes a first rim on the first disc and a second rim on the second disc.

14. The apparatus of claim 12 in which the first and second handles are adapted to be secured to the first and second discs at different locations to vary the radius through which force is applied to rotate the discs.

* * * * *